United States Patent [19]

Bucefari et al.

[11] Patent Number: 4,903,475

[45] Date of Patent: Feb. 27, 1990

[54] APPARATUS FOR THE PRODUCTION OF ORNAMENTAL CHAINS OF THE TYPE KNOWN AS "PEACOCK EYE"

[75] Inventors: Massimo Bucefari; Corrado Lapini; Michele Lazzarini, all of Arezzo, Italy

[73] Assignee: C.M.S.S.p.A. Costruzione Macchine Speciali, Arezzo, Italy

[21] Appl. No.: 152,731

[22] Filed: Feb. 5, 1988

[30] Foreign Application Priority Data

Feb. 6, 1987 [IT] Italy ..... 9322 A/87

[51] Int. Cl.[4] ..... B21L 7/00

[52] U.S. Cl. ..... 59/16; 59/20; 59/25

[58] Field of Search ..... 59/7, 16, 17, 20, 23, 59/24, 25

[56] References Cited

U.S. PATENT DOCUMENTS 4,127,987 12/1978 Tega et al. ..... 59/16
4,175,379 11/1979 Tega ..... 59/16
4,275,555 6/1981 Bichi ..... 59/17
4,311,003 1/1982 Tega ..... 59/16
4,548,031 10/1985 Massimo et al. ..... 59/16

*Primary Examiner*—David Jones
*Attorney, Agent, or Firm*—Browdy and Neimark

[57] ABSTRACT

An apparatus for producing ornamental chains of the type known as "peacock eye", formed by a sequence of pairs of links, of the twisted type, each pair including one small and one large link, which are concentric, the large link engaging the large and small links of the immediately preceding and subsequent pairs. The apparatus is substantially of the type capable of producing chains having alternating links, and comprises, in association with the unit for producing the large links, devices for advancing the chain already formed towards an elevated collection unit and for moving the end length of chain, freely suspended, to bring it successively into alignment with the spiral of wire from which the large link is made and with the unit for forming the said large link already concatenated. A mobile pincer undertakes the transportation of the small links towards the production unit of the large links and the allocation of the latter to the first loop of the spiral.

10 Claims, 3 Drawing Sheets

APPARATUS FOR THE PRODUCTION OF ORNAMENTAL CHAINS OF THE TYPE KNOWN AS "PEACOCK EYE"

DESCRIPTION

1. Field of the invention

The present invention relates to an apparatus for the automatic production of a type of chain identified in the goldsmithery and jewelry sector by the name "peacock eye".

2. State of the art

It is known that this type of chain is substantially a chain having alternating large and small twisted links and formed by a sequence of pairs of concentric large and small twisted links, in which the large link of each pair engages with the small link of the preceding pair and of the subsequent pair. FIG. 1 attached illustrates the type of chain described above as produced by means of the apparatus forming the subject of the invention and prior to any surface finishing operations.

Chains having ornamental links of the "peacock eye" type have hitherto been produced by means of exclusively manual techniques. This fact makes the manufacture of such chains very laborious, and the finished product therefore expensive.

The object of the present invention is to provide an apparatus which permits automatic production of the abovementioned type of ornamental chain, thus permitting a higher rate of production and a substantial reduction in the manufacturing costs.

Structurally, the apparatus according to the invention is of the type conventionally used for the production of chains having alternating links, for example of the type having two independent stations (as illustrated in U.S. Pat. No. 4,548,031) or of the type having two stations which are made interdependent by the effect of a mobile pincer, which, in addition to ensuring the transfer of the chain being formed from one station to the other, also participate in the operations of forming the link at both the stations and of concatenation (as described in German Pat. No. 2,804,310), or finally of the type comprising a single manufacturing station associated with means suitable for providing one of the two types of link produced separately. In contrast to these types of apparatus, in the apparatus according to the present invention the links are engaged one by one at one end of the chain which is held suspended in alignment with the unit forming the links and for concatenation and is intermittently advanced towards a chain collecting assembly positioned above the said units. Moreover, during the stage of concatenation of the large link with the last pair of large and small links already formed, the chain is caused to execute an alternating movement in the axial direction to facilitate concatenation. In this manner, under the effect of their own weight, the links, suspended from one another, adopt a configuration such as to create between them the space for the insertion and passage of the new link, without requiring the use of auxiliary devices to position and support the links. Moreover, the alternating movement of the end length of chain which accompanies the concatenation of the new link has the effect that the axis of the wire of the latter is constantly positioned close to the center of the space between the links already concatenated which is available for the insertion of the new link, thus avoiding any tension between the links respectively concerned resulting in their deformation.

SUMMARY OF THE INVENTION

According to the invention, a machine is thus provided for the production of an ornamental chain of the type known as "peacock eye" in the goldsmithery and jewelry industries, wherein the said machine comprises: a production unit for the large links including a feed assembly for material in wire form and for the formation of a spiral therefrom, an assembly for cutting the individual loops of the said spiral after each of its revolutions through 360°, means for forming the links from the said loops; means for providing the small links, comprising at least one pincer for feeding the latter to the said production unit for the large links, capable of engaging a small link in each loop of the said spiral; means for pulling the said chain towards a collection assembly operating above the said production unit for the large links, in an intermittent manner at the end of the phase of concatenation and formation of each large link, capable of keeping an end length of chain suspended along an axis perpendicular to that of the said spiral; means for imparting at least to the said end length of chain an alternating movement along the said axis, from an initial position, in which the said pulling means are operational, including a phase of approaching the said spiral, until the last pair of links already formed is brought into alignment with the free end of the spiral, a phase of approaching the said means for forming the link after the concatenation of the appropriate loop of the spiral, and a phase of return towards the said initial position, between the first two phases, during the concatenation of the loop to the said last pair of links already formed, a further alternating movement along the said axis being provided, which takes place in the arc of a complete rotation of the said spiral.

BRIEF DESCRIPTION OF THE DRAWINGS

Further features and advantages of the apparatus for the production of an ornamental chain of the "peacock eye" type will be more clearly apparent from the description which follows of one embodiment thereof, given by way of nonlimiting example, and with reference to the attached drawings in which.

DESCRIPTION OF A PREFERRED EMBODIMENT

Figure 2:
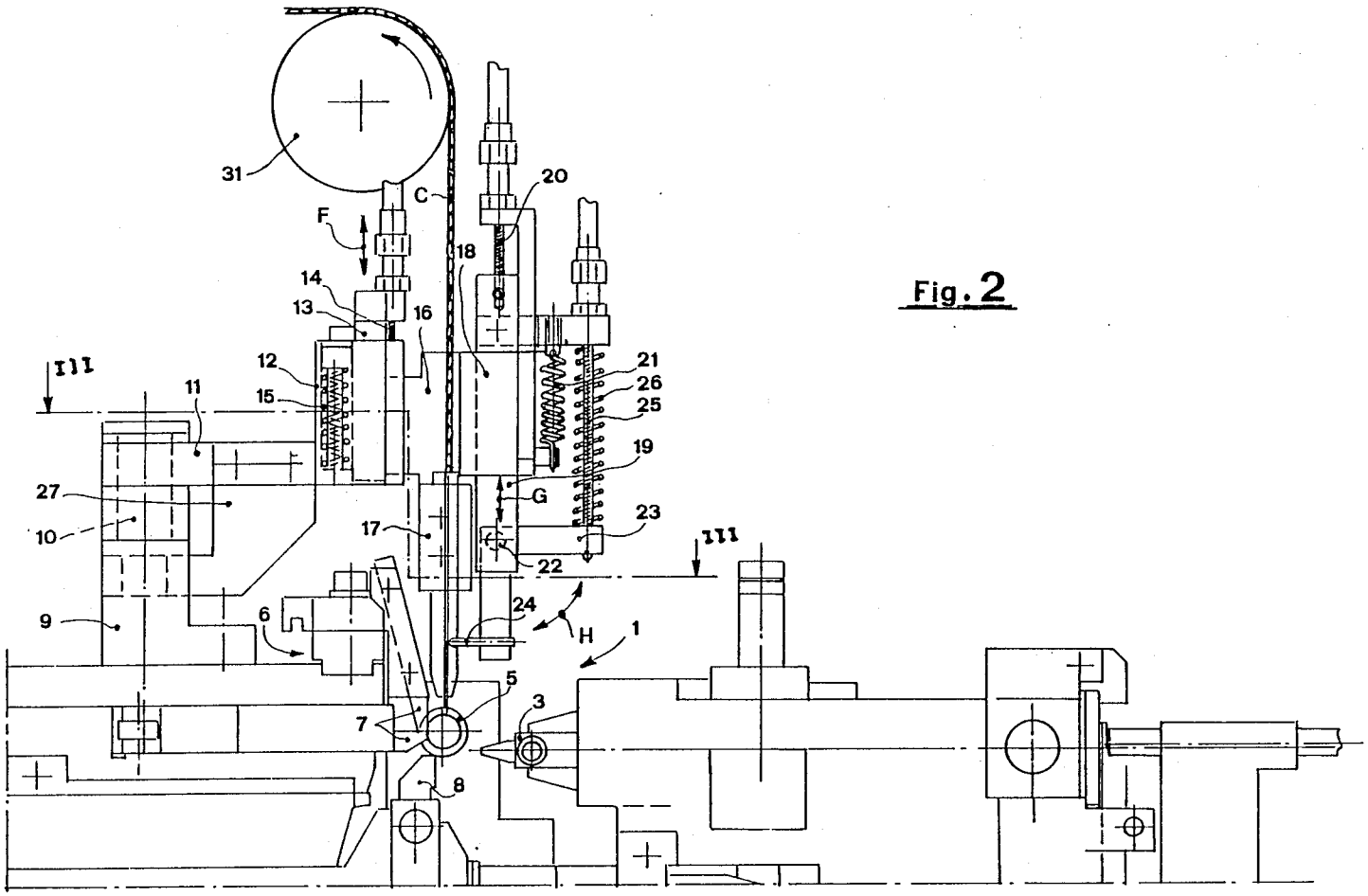
FIG. 2 shows a lateral view of the apparatus according to the invention.
Figure 3:
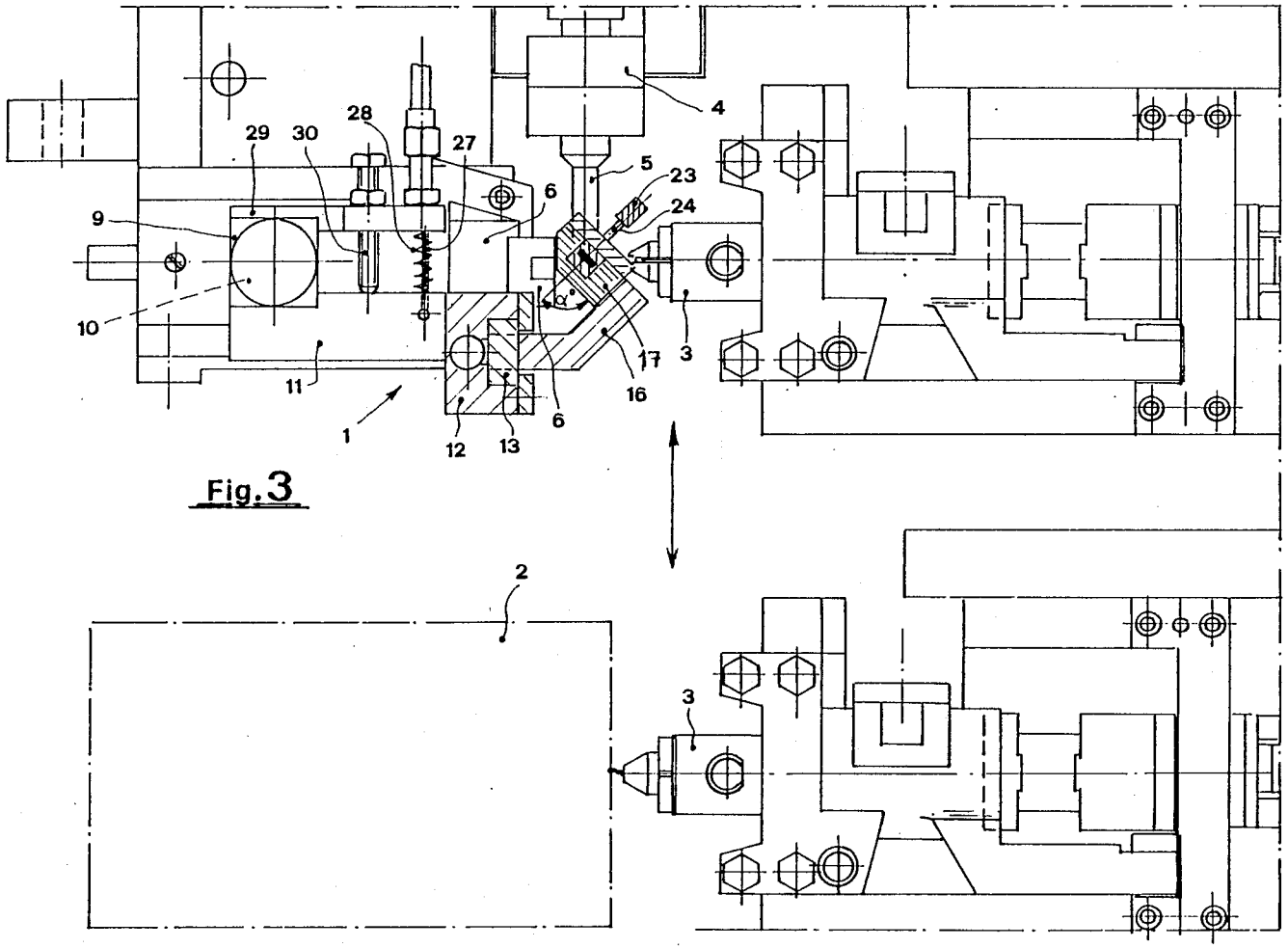
FIG. 3 shows a plan view from above, partially in section, of the apparatus of FIG. 2.

As already specified above, the basic structure of the apparatus according to the present invention is that of a machine for the production of chains having alternating links, that is to say chains formed by a sequence of links or groups of links of different characteristics (shape, size). The structure of such machines, being well known to those skilled in the art, will not be further discussed in detail here, and reference may be made by way of example to U.S. Pat. No. 4,548,031 and German Pat. No. 2,840,310 quoted above. With reference to FIGS. 2 and 3, such machines are substantially made up of a first unit for the production of one type of link, generically designated 1, and a second unit, shown generically in FIG. 3 by the block 2, capable of providing the second type of link which is fed to the first unit 1 by means of a mobile pincer 3.

The first unit 1 comprises a feed assembly 4 for material in wire form, particularly precious material, and for forming a spiral 5 with the said material, a cutting assembly 6 provided with a pair of blades 7 for separating the individual loops of said spiral after each 360° revolution thereof, means for shaping the ends of the links 8 (façons) for closing and deforming each link, in cooperation with the pincer 3, after concatenation. The second unit 2 may be formed by a device for distributing the second type of link, produced separately, which links are picked up by means of the pincer 3 and fed to the unit 1, or may be formed by an independent unit for producing the second type of link, similar to the first unit 1, from which the mobile pincer 3 picks up the links produced one at a time to feed them to the unit 1. The mobile pincer 3, in this latter case, may be common to the two units, cooperating first with one and then with the other in the phase of formation of the links, and ensuring the transfer of one type of link from one unit to the other, or may operate exclusively as a transfer pincer, in which case each unit is provided with its own auxiliary pincer which operates in the phase of forming the link. This is in conformity with what is described and illustrated in the abovementioned patent applications.

The apparatuses of conventional type, such as those referred to above, for the production of chains having alternating links, merely permit the mutual concatenation of individual links having different characteristics (for example, a sequence of alternating large and small links). The "peacock eye" chain, however, as already stated, envisages a concatenation of pairs of links, of the twisted type, each pair comprising one large link and one concentric small link of which the large link engages the large link and the small link forming the preceding pair and the subsequent pair.

In order to obtain the abovementioned concatenation, in the apparatus according to the invention, the first unit 1, which in the present embodiment is that intended for the production of the large links, possesses a block 9 positioned above the cutting assembly 6, bearing a shaft 10 on which is pivotably mounted a first horizontal arm 11, on the free end of which is made a vertical guide 12, within which a first runner 13 is slidingly mounted. The alternating sliding of the runner 13 relative to the guide 12 according to the arrow F in FIG. 2 is obtained by means of a traction cable 14 operating in opposition to a compression spring 15. From the first runner 13 there extends horizontally a second arm 16 bearing a tubular guide 17 for the chain, designated C, xxxxxxxxx (sic) and a further vertical guide 18, within which is slidingly engaged a second runner 19. The alternating sliding of the runner 19 relative to the guide 18 is obtained by means of a traction cable drive 20, engaging with one end of the runner 19 and operating in opposition to a compression spring 21. The axis of the tubular guide 17 for the chain C is parallel to the direction of sliding of the runners 13 and 19 and aligned with the operating axis of the façons 8, and is thus perpendicular to the feed direction of the spiral 5.

At the other end of the runner 19 there is articulated, at 22, a small right-angled lever 23 the arm of which, aligned with the runner 19, possesses at its end a pointed pin 24 perpendicular to the axis of the tubular guide 17 and, therefore, to the axis of advance of the chain C. The end of the other arm of the small lever 23 is connected to a traction cable 25 operating in opposition to a compression spring 26, as a result of which the small level 23 can undergo alternating and intermittent angular displacements according to the arrow H in FIG. 2 about the shaft 22, the pin 24 thus moving towards and away from the chain C. With reference to the tubular guide 17, the pin 24 is therefore caused to execute a sliding movement parallel to the latter and an approaching and retiring movement, both alternating and intermittent.

The arm 11 can undergo limited angular displacements about its own shaft 10, and for this purpose is connected at an intermediate point thereof to a traction cable 27 acting horizontally and operating in opposition to a compression spring 28 which is arranged coaxially with the cable 27 between the said arm 11 and a fixed support 29 extending from the block 9. The support 29 also carries a stop screw 30, parallel to the cable 27 in opposition to the arm 11.

Figure 1:
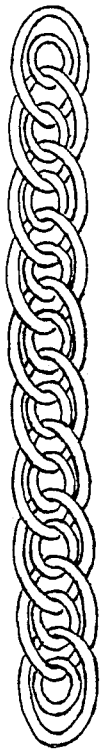
FIG. 1 shows a section of the ornamental chain produced by means of the apparatus according to the invention.
Figure 4:
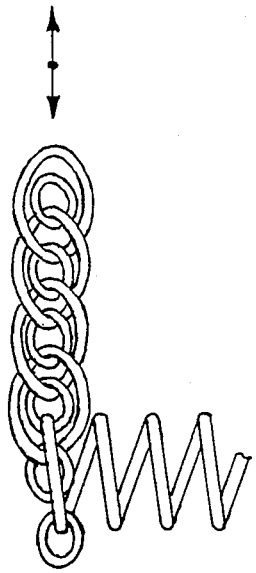
FIG. 4 shows the phase of concatenation of the chain which is carried out in the apparatus according to the invention.

The mode of operation of the apparatus according to the invention is described below, reference also being made to FIG. 4. The pincer 3 transfers a small link M2 from the second unit 2 to the first unit 1, depositing it on the end of the spiral of wire 5 from which the loop for the formation of the long link M1 will be made. The end length of the chain already manufactured, protruding from the tubular guide 17 and initially higher than the axis of the spiral, gradually approaches the latter as the result of the sliding of the first runner 11 relative to the guide 12. When, during this movement, the center of the last pair of large and small links already formed is in alignment with the end of the first loop of the spiral, on which a small link is already engaged, as a result of the rotation of the spiral, the end of the loop engages between the said pair of links. In the course of concatenation of the large link M1, that is to say in the arc of a complete rotation of the spiral 5, the runner 13 executes an alternating movement within the principal alternating movement, of an extent substantially equal to the diameter of the spiral 5, in a manner such that the wire forming the loop which is engaging in the last pair of links already formed is always situated substantially at the center of the said pair. This facilitates the concatenation operations, in that it prevents the wide loop from which the large link is made from being forced against the links already formed and undergoing deformation. When the rotation of the spiral is finished, while the blades 7 separate the loop from the latter, the pincers 3 grip the loop from one side while the runner 13 continues its sliding towards the façons 8 which grips the loop, closing it and twisting it. Subsequently, while the façons 8 open and the pincers 3 retract and undergo a translatory movement towards the second unit 2, the runner 13 begins its return travel to bring the chain back into the initial position. At this point, the chain is caused to advance by one step, corresponding to the length of a long link M1, towards an elevated collecting drum 31. For this purpose, the mandrel 24, which throughout all the preceding stages has remained engaged in one of the pairs of links previously formed, slides relative to the guide 17 by a distance corresponding to the abovementioned length, pulling the length of chain situated below upwards and permitting the chain, which is kept under a constant slight tension, to be wound on the drum 31.

Before the mandrel 24 is returned to its initial position, it is disengaged from the chain, the small lever 23 being displaced angularly by actuation of the cable 25. Hence, the traction on the cable 20 being finished, the spring 21 returns the runner 19 and hence the mandrel 24 to its initial lower position and, finally, the traction exerted by the cable 25 being finished, the spring 26 drives the inverse angular displacement of the small lever 23 and the resulting engagement of the mandrel 24 in the pair of chain links situated below that in which it was previously engaged. At this point, the cycle described above is repeated.

During the stage which precedes concatenation, the arm 11 is subjected to a slight jerk by means of the traction cable 27 and the associated spring 28, producing a rotation about the shaft 10 which is very limited in amplitude but is sufficient to shake slightly the end length of the chain being formed, favoring the natural arrangement of the links at their lowest point, each being suspended from the preceding one, thus ensuring that the space between the said links for concatenation is constantly guaranteed.

The sequence and synchronization of the movements of the various members of the apparatus according to the invention, and in particular the driving actions transmitted by means of the traction cables 14, 20, 25 and 27, are obtained by actuating means of the generally conventional type, for example mechanical means such as cams and rocker arms, or electro-mechanical or pneumatic means, which may be controlled electronically. Furthermore, it is apparent that, although in the present embodiment of the invention transmission of commands via a metal cable has been envisaged, any other equivalent type of transmission could be used as an alternative, for example by means of levers.

The chain produced with the apparatus according to the invention possesses good stability even before welding, and can therefore be produced in sections of substantial length, whose links are welded in succession. The chain then generally undergoes surface treatment, for example by means of embellishment with diamonds, to give it its final appearance.

Variations and modifications can be made to the apparatus for the production of an ornamental chain of the type known as "peacock eye" according to the present invention, without thereby departing from the scope of protection of the said invention.

I claim:

1. Apparatus for the production of an ornamental chain of the type known as "peacock eye" in the goldsmithery and jewelry industries, the said chain being formed by a sequence of pairs of links, of the twisted type, each pair comprising one large and one small link, which are concentric, the large link engaging the large and small links forming the preceding pair and subsequent pair, the said apparatus comprising a production unit for the large links including at least one feed assembly for a material in wire form and for the formation of a spiral therefrom, an assembly for cutting the individual loops of the said spiral after each of its revolutions through 360°, and means for forming links from the said loops;

means for providing the small links, comprising at least one pincer for feeding the latter to the said production unit for the large links, capable of engaging a small link for each loop of the said spiral;

means for pulling the said chain towards a collecting unit operating above the said production unit for the large links, in an intermittent manner at the end of the phase of concatenation and formation of each large link, capable of keeping an end length of chain suspended along an axis perpendicular to that of the said spiral;

means for imparting at least to the said end length of chain an alternating movement along the said axis from an initial position, in which the said pulling means are operational, including a phase of approaching the said spiral, until the last pair of links already formed are brought into alignment with the free end of the spiral, a phase of approaching the said means for forming the link after the concatenation of the appropriate loop of the spiral, and a phase of return towards the said initial position, between the first two phases, during the concatenation of the loop to the said last pair of links already formed, a further alternating movement along the said axis being provided, which takes place in the arc of a complete rotation of the said spiral.

2. Apparatus as claimed in claim 1, wherein the amplitude of the alternating movement corresponding to the phase of concatenation of the large link is substantially equal to the diameter of the spiral.

3. Apparatus as claimed in claim 1, wherein the unit for collecting the chain already formed is situated above the production unit for the large links, as a result of which the advancing movement of the chain already formed takes place in an upward vertical direction.

4. Apparatus as claimed in claim 1, wherein the said means for providing the small links comprise a device for distributing small links produced separately, interacting with the said feed pincer.

5. Apparatus as claimed in claim 1, wherein the said means for providing the small links comprise a production unit for the small links including a feed assembly for material in wire form and the formation of a spiral therefrom, an assembly for cutting the individual loops of the said spiral after each of its revolutions thereof through 360°, and means for forming links from the said loops interacting with the said feed pincer.

6. Apparatus as claimed in claim 5, wherein the said means for forming links from the said loops comprise a link forming pincer capable of closing the link and an auxiliary pincer for supporting the said link interacting with the said feed pincer for the links which undertakes the transference and allocation of the small links to the production unit for the large links.

7. Apparatus as claimed in claim 1, wherein the said means for imparting an alternating movement of at least the said end length of chain comprise a support located above the said unit for the production of the large links, bearing a horizontal arm to which is slidingly connected a guide for the chain, capable of supporting the said end length of chain in the vertical position.

8. Apparatus as claimed in claim 7, wherein the said means for pulling the chain comprise means for engaging the last pair of small and large links already formed, slidingly connected relative to the said chain guide along a direction parallel thereto.

9. Apparatus as claimed in claim 8, wherein the said means for engaging the last pair of links of the chain, already formed, comprise a mandrel perpendicular to the chain supported by lever means articulated on a runner which is slidable relative to the said chain guide and displaceable angularly away from and towards the latter.

10. Apparatus as claimed in claim 7, wherein the said horizontal arm is articulated on the said support, and means are provided for imparting a very limited angular displacement about an operating position thereof before each phase of concatenation of a large link on the end length of chain.

* * * * *